United States Patent [19]

Moeller

[11] Patent Number: 4,896,825

[45] Date of Patent: Jan. 30, 1990

[54] FOLDABLE ASHTRAY

[75] Inventor: Robert E. Moeller, New Milford, N.J.

[73] Assignee: Alford Industries Inc., Ridgefield Park, N.J.

[21] Appl. No.: 299,454

[22] Filed: Jan. 18, 1989

[51] Int. Cl.[4] ..... B65D 73/00

[52] U.S. Cl. ..... 229/167; 131/238; 131/241; 229/117

[58] Field of Search ..... 229/167, 173, 41 R, 229/41 B, 117, 120.21, 166, 168; 131/231, 238, 240.1, 241; 206/45.19

[56] References Cited

U.S. PATENT DOCUMENTS

| | | | |
|---|---|---|---|
| 2,006,811 | 7/1935 | Mersbach | 131/240.1 |
| 2,071,394 | 2/1937 | Douglas | 229/1.5 B |
| 2,179,081 | 11/1939 | Bench, Jr. | 131/240.1 |
| 2,430,609 | 11/1947 | Guyer | 229/167 |
| 2,465,169 | 3/1949 | O'Connor | 229/173 |
| 2,743,730 | 5/1956 | Heaton | 131/240.1 |
| 2,781,160 | 2/1957 | Bolding | 229/41 B |
| 2,796,211 | 6/1957 | Wagner | 229/3.5 MF |
| 2,836,340 | 5/1958 | Crowley | 206/496 |
| 3,002,672 | 10/1961 | Kotowick | 229/167 |
| 3,136,473 | 6/1964 | Kieffer | 229/166 |
| 3,342,317 | 9/1967 | Barron | 206/496 |
| 3,401,702 | 9/1968 | Rossman | 131/240.1 |
| 3,491,773 | 1/1970 | Herbert | 131/241 |
| 4,577,758 | 3/1986 | Gilda et al. | 206/496 |

FOREIGN PATENT DOCUMENTS

| | | | |
|---|---|---|---|
| 803432 | 9/1936 | France | 131/240.1 |
| 2603556 | 3/1988 | France | 131/231 |

*Primary Examiner*—Gary Elkins

*Attorney, Agent, or Firm*—Ostrolenk, Faber, Gerb & Soffen

[57] ABSTRACT

A paper blank for a disposable ashtray which can be compactly folded for packaging and readily assembled by a consumer for use. The bottom flap of the assembled ashtray is secured in place by tabs received within slots. The ashtray may include cigarette receiving slots and a snuffer.

14 Claims, 8 Drawing Sheets

FIG. 4.
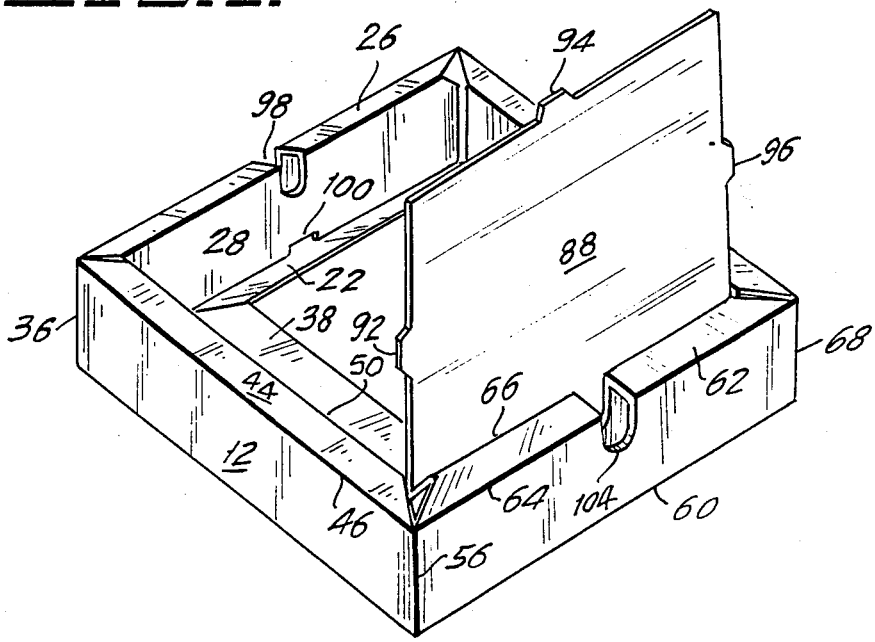
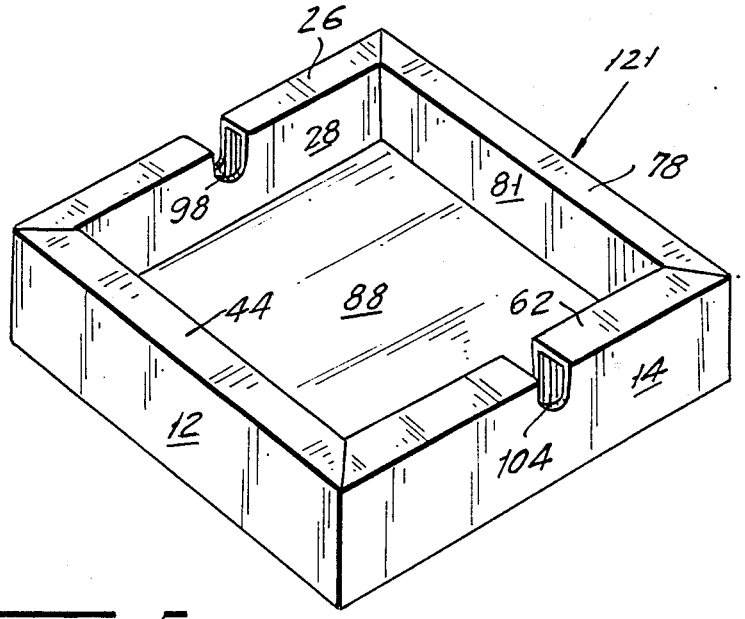
FIG. 5.

FIG. 16.
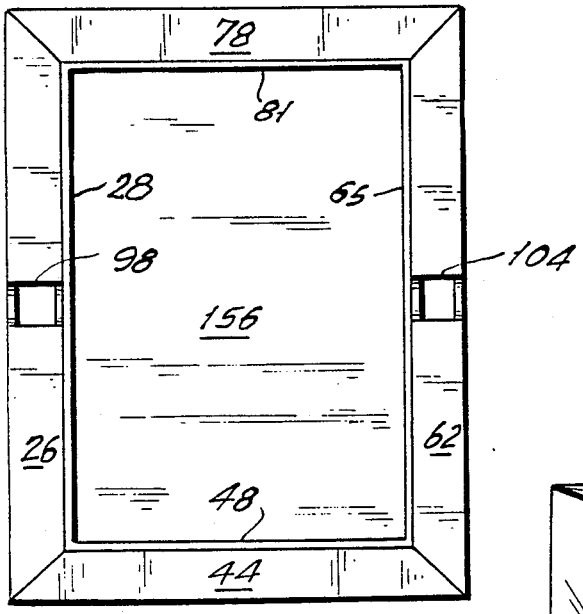
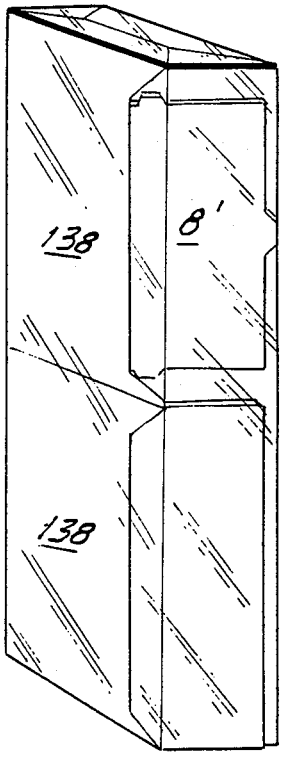
FIG. 11.

FIG. 12.
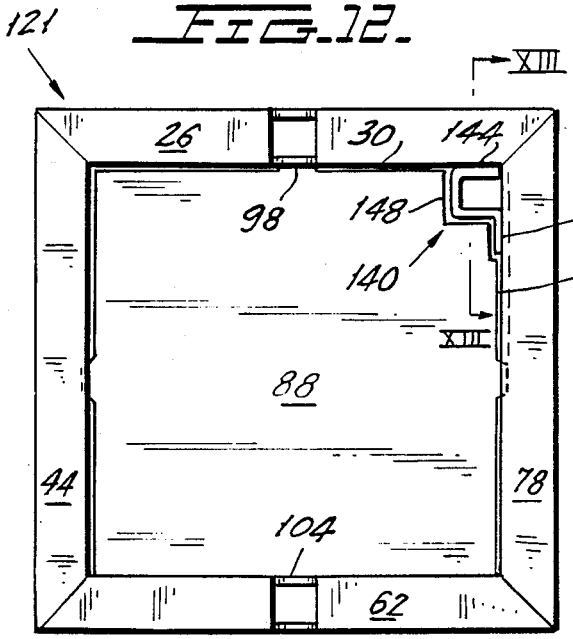
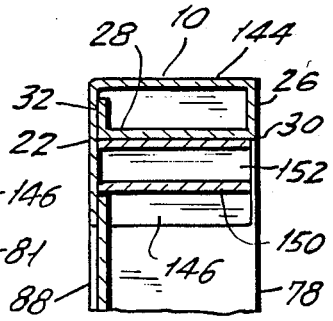
FIG. 13.
FIG. 14.
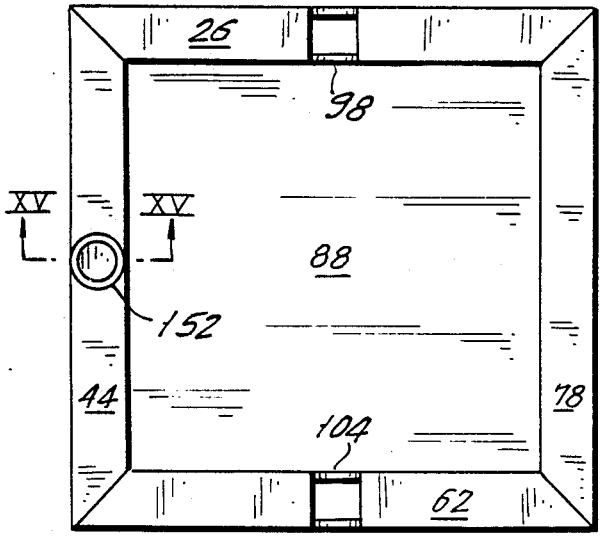
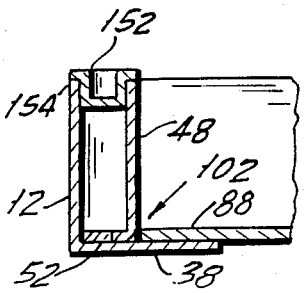
FIG. 15.

FOLDABLE ASHTRAY

BACKGROUND OF THE INVENTION

1. Field of the Invention

The invention relates generally to a blank which can be compactly folded for packaging and subsequently assembled into a receptacle. More particularly, the invention relates to a paper blank for a disposable ashtray which can be compactly packaged with one or more packs of cigarettes and subsequently assembled by a consumer for use.

2. Description of the Related Art

Foldable ashtrays are well known in the art. For example, U.S. Pat. No. 2,071,394 to Douglas describes an ashtray which can be handed out in a flat pack in the form of, e.g., a business card. U.S. Pat. No. 2,796,211 to Wagner describes a disposable ashtray of frusto-pyramidal form. U.S. Pat. No. 2,836,340 to Crowley describes a disposable ashtray which can be handled, stored and shipped in a partially formed, flattened condition. U.S. Pat. No. 3,342,317 to Barron, describes a foldable ashtray which can be carried in a folded compact condition by a smoker and quickly erected for use. U.S. Pat. No. 4,577,758 to Gilda et al. describes a reusable ashtray which can be used to extinguish cigarettes.

However, the foldable astrays of the prior art have not been entirely satisfactory. In particular, the prior art devices are not satisfactorily convenient for consumers, economic to manufacture or aesthetically pleasing.

It is therefore an object of the present invention to provide a foldable ashtray which overcomes the above-noted deficiencies of the prior art.

SUMMARY OF THE INVENTION

The present invention is a foldable ashtray which has four side panels, each connected by a fold line to a respective bottom flap. The bottom flaps each form a portion of the bottom of the ashtray. The first three side panels are connected together by fold lines, and the fourth side panel is affixed to the first side panel to form the ashtray. A bottom panel with at least one tab is connected by a fold line to one of the side panels, and at least one of the other side panels has a tab receiving slot into which the tab of the bottom panel is received to secure the bottom panel in position above the bottom flaps to complete the bottom of the ashtray.

The bottom panel can include additional tabs which are received into additional receiving slots in other side panels. The bottom panel can also include a fold line across its center so that the blank can be compactly folded for packaging.

The side panels of the ashtray are preferably double-walled structures with inner walls, outer walls, and top panels. The ashtray preferably includes slots in the top panels for holding a cigarette. A foldable or rigid snuffer can be included in the top panel of the ashtray.

The foldable ashtray of the invention can be sold in combination with cigarettes, either folded with the cigarette packs alongside, or assembled with a cigarette pack inside the ashtray.

BRIEF DESCRIPTION OF THE DRAWINGS

These and other features and advantages of the present invention will become apparent when the following text is read in conjunction with the accompanying drawings, in which:

FIG. 4 is a perspective view of the blank of FIG. 1 in an intermediate stage of assembly;

FIG. 5 is a perspective view of the blank of FIG. 1 after the blank has been assembled into an ashtray;

FIG. 11 is a perspective view of the folded blank of FIG. 9 in combination with a double pack of cigarettes;

FIG. 12 is a plan view of an ashtray with a foldable snuffer in accordance with the invention;

FIG. 13 is a cross-sectional view through the line XIII—XIII in FIG. 12;

FIG. 14 is a plan view of an ashtray with a rigid snuffer in accordance with the invention.

FIG. 15 is a cross-sectional view through the line XV—XV in FIG. 14;

FIG. 16 is a perspective view of a rectangluar ashtray in combination with a pack of cigarettes.

DESCRIPTION OF THE PREFERRED EMBODIMENTS

Figure 1:
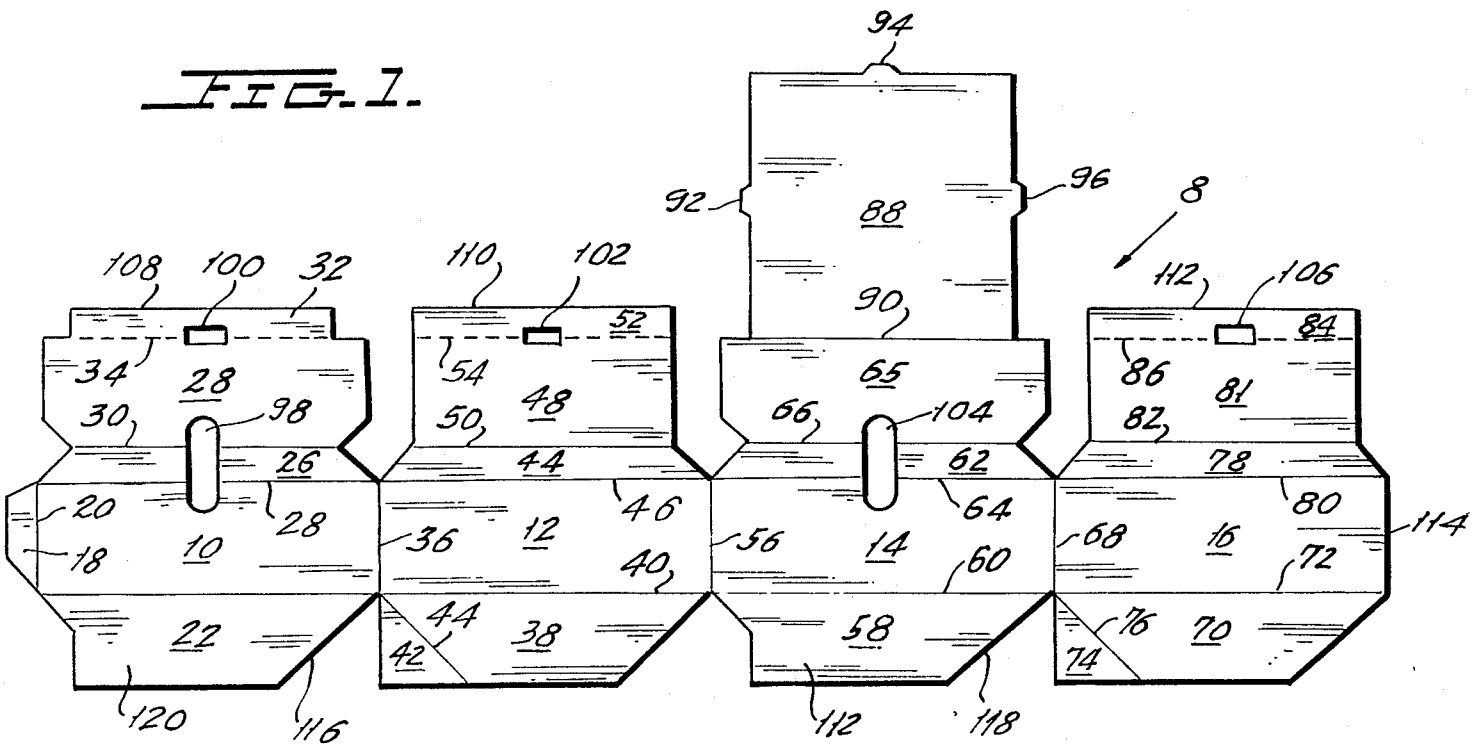
FIG. 1 is a front view of a blank in accordance with the invention.

Referring to FIG. 1, a blank 8 in accordance with a first embodiment of the invention includes an outer side panel 10, an outer side panel 12, an outer side panel 14 and an outer side panel 16. Outer side panel 10 is connected to a side tab 18 by a score 20, a bottom flap 22 by a score 24 and a top side panel 26 by a score 28. Top side panel 26 is connected to an inner side panel 28 by a score 30. Inner side panel 28 is connected to an inner tab 32 by a perforation 34. Outer side panel 10 is connected to outer side panel 12 by a score 36. Outer side panel 12 is connected to a bottom flap 38 by a score 40. Bottom flap 38 is connected to a triangular tab 42 by a score 44. Outer side panel 12 is connected to a top side panel 44 by a score 46. Top side panel 44 is connected to an inner side panel 48 by a score 50. Inner side panel 48 is connected to an inner tab 52 by a perforation 54. Outer side panel 12 is connected to outer side panel 14 by a score 56. Outer side panel 14 is connected to a bottom flap 58 by a score 60 and a top side panel 62 by a score 64. Top side panel 62 is connected to an inner side panel 65 by a score 66. Outer side panel 14 is connected to outer side panel 16 by a score 68. Outer side panel 16 is connected to a bottom flap 70 by a score 72. Bottom flap 70 is connected to a triangular tab 74 by a score 76. Outer side panel 16 is connected to a top side panel 78 by a score 80. Top side panel 78 is connected to an inner side panel 81 by a score 82. Inner side panel 81 is connected to an inner tab 84 by a perforation 86.

Inner side panel 65 is connected to a bottom panel 88 by a score 90. Bottom panel 88 includes three bottom panel tabs 92, 94 and 96.

A cigarette receiving slot 98 is cut through outer side panel 10, top side panel 26 and inner side panel 28. A tab receiving slot 100 is cut through inner side panel 28 and inner tab 32. A tab receiving slot 102 is cut through inner side panel 48 and inner tab 52. A cigarette receiving slot 104 is cut through outer side panel 14, top side panel 62 and inner side panel 65. A tab receiving slot 106 is cut through inner side panel 81 and inner tab 84.

Scores 20, 24, 28, 30, 36, 40, 46, 50, 56, 60, 64, 66, 68, 72, 80 and 82 are formed by pressing downwardly on the front of the blank 8. Scores 44, 76 and 90 are formed by pressing upwardly from the back of the blank 8.

All of the cuts, scores and perforations are formed in a single process with a rotary die cutter, reciprocating die cutter or the like.

Blank 8 itself is formed of solid bleached sulfate laminated on both sides with 0.003" (0.08 mm) aluminum foil. Alternatively, only the front of the blank (part of which ultimately forms the inside surface of the ashtray which will contact hot ash) is laminated with aluminum foil. The foil is treated with a heat resistant lacquer. The blank is then printed with promotional or advertising material. The blank is then treated again with heat-resistant lacquer. The aluminum foil with the heat resistant lacquer protects the paper ashtray from a burning cigarette or hot ash.

FOLDING FOR PACKAGING

Blank 8 is folded for packaging by bending each of the scores 24, 28 and 30 and perforation 34 by 90° until the front of inner tab 32 is adjacent the back of bottom flap 22 with an edge 108 of inner tab 32 adjacent the back of the score 24. Similarly, each of scores 40, 46 and 50 and perforation 54 are bent 90° until the front of inner tab 52 is adjacent the back of bottom flap 38 with an edge 110 of inner tab 52 adjacent the back of score 40. Similarly, each of scores 72, 80 and 82 and perforation 86 are bent 90° until the front of inner tab 84 is adjacent the back of bottom flap 70 with an edge 112 of inner tab 84 adjacent the back of score 72. The front of inner tab 32 is then glued to the back of bottom flap 22. Similarly, the front of inner tab 52 is glued to the back of bottom flap 38, and the front of inner tab 84 is glued to the back of bottom flap 70. The scores 60, 64 and 66 are then bent 90° until the back of the score 90 is adjacent the back of the bottom flap 58. The back of bottom panel 88 is then glued to the back of bottom flap 58. Score 90 is bent 180° until the front of bottom panel 88 is adjacent the front of inner side panel 65, which flattens the partially folded blank 8.

Scores 20, 36, 56 and 68 are then bent until the front of side tab 18 is adjacent the back of outer side panel 16, with the front of score 20 adjacent an edge 114 of outer side panel 16. The front of side tab 18 is glued to the back of outer side panel 16. The back of triangular tab 42 is glued to the front of bottom flap 22 with an edge 116 of the bottom flap 22 adjacent score 44. Similarly, the back of triangular tab 74 is glued to the front of bottom flap 58 with an edge 118 of bottom flap 58 adjacent score 76.

Figure 2:
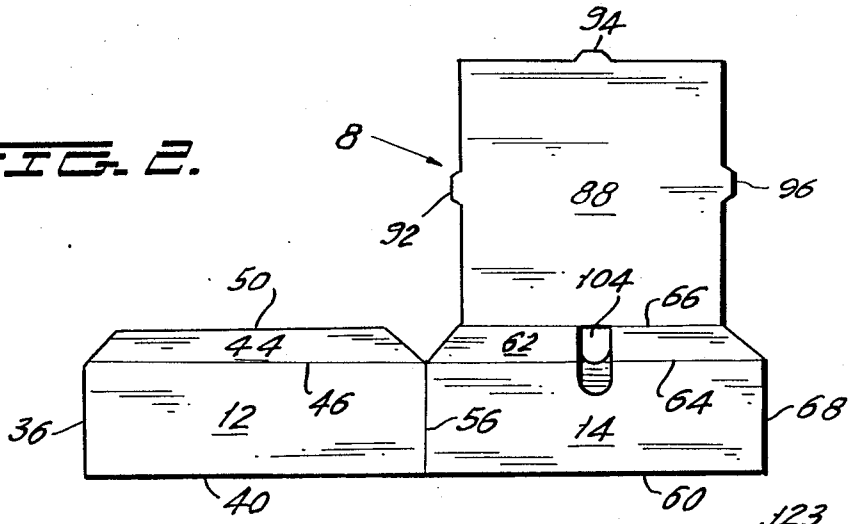
FIG. 2 is a front view of the blank of FIG. 1 after the blank has been folded for packaging.
Figure 3:
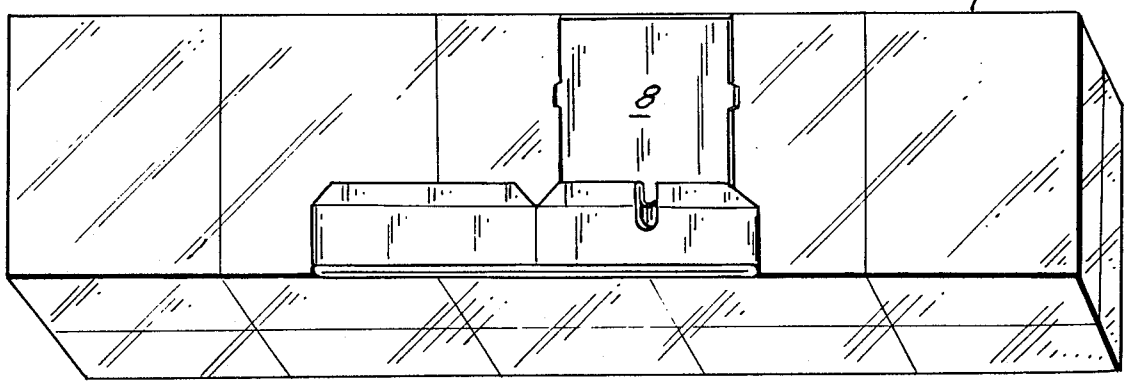
FIG. 3 is a perspective view of the folded blank of FIG. 2 in combination with a carton of cigarettes.

After these folding and glueing steps, the blank appears as illustrated in FIG. 2 and can be packaged alongside a carton of cigarettes 123 as illustrated in FIG. 3 for sale to consumers.

Figure 6:
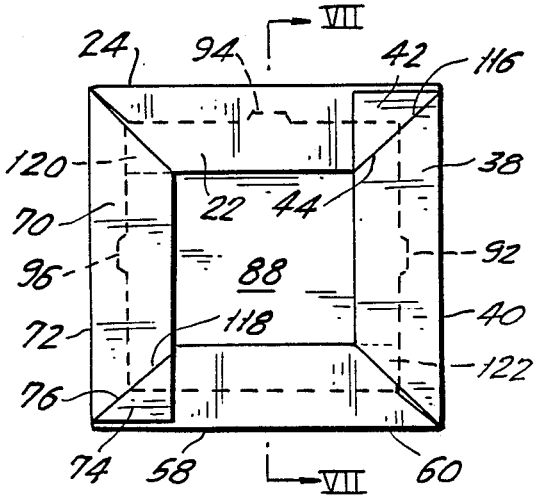
FIG. 6 is a bottom view of the ashtray of FIG. 5.
Figure 7:
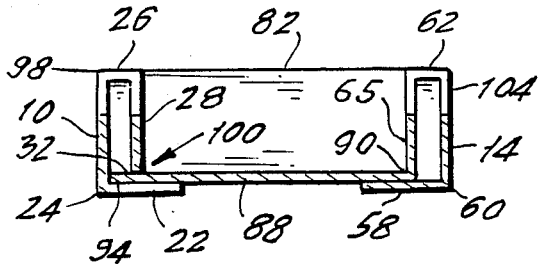
FIG. 7 is a cross-sectional view through the line VII—VII in FIG. 6.

From the folded position, the blank can be expanded by pressing on scores 36 and 68 (FIG. 4) to form a square ashtray 121 (FIG. 5) with double walls. A corner 120 of bottom flap 22 covers bottom flap 70 and a corner 122 of bottom flap 58 covers bottom flap 38 as illustrated in FIG. 6. Bottom panel 88 is folded downwardly by the consumer until bottom panel tabs 92, 94 and 96 snap into tab receiving slots 102, 100 and 106, respectively, with the bottom panel 88 positioned over the bottom flaps 22, 38, 58, and 70.

MODIFIED CIGARETTE RECEIVING SLOTS

Figure 8:
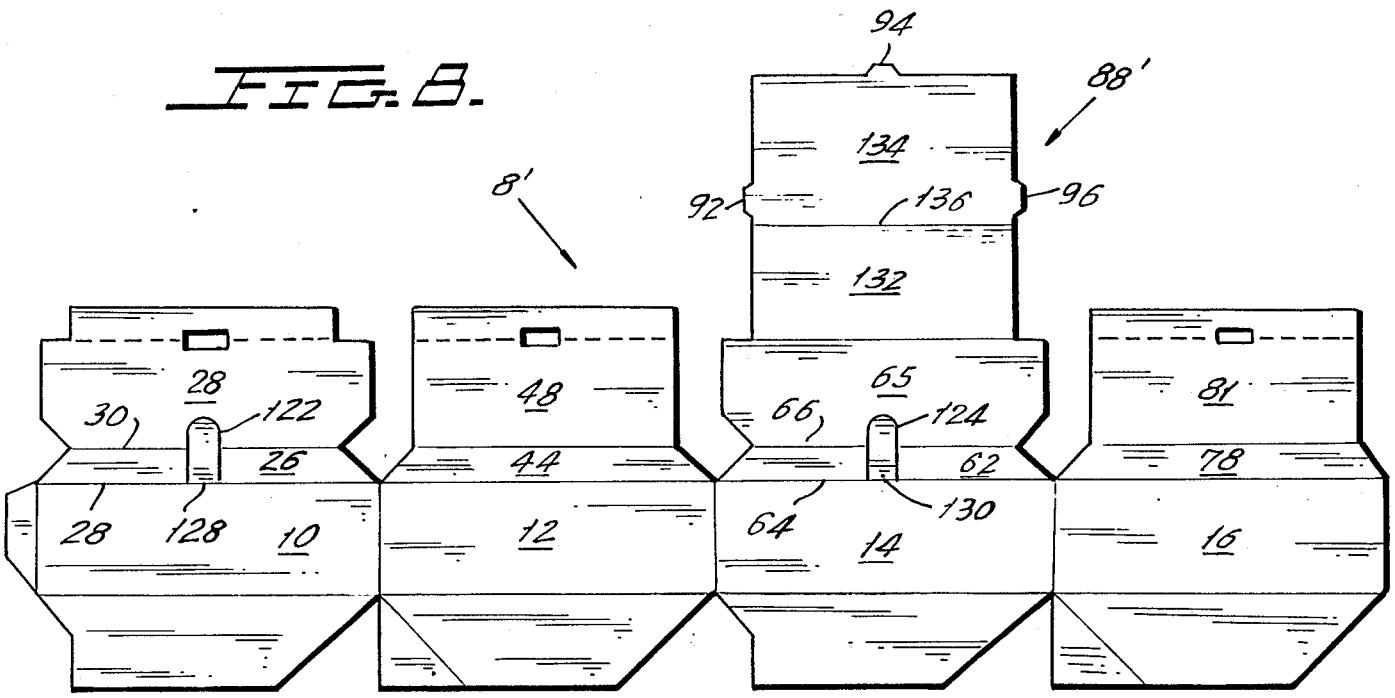
FIG. 8 is a front view of a blank in accordance with the invention.

In an alternative illustrated in FIG. 8, the cigarette receiving slots are modified as indicated at 122 and 124. Modified receiving slots 122 and 124 do not extend through outer side panel 10 or outer side panel 14. Rather, modified cigarette receiving slots 122 and 124 extend only through the inner and top side panels, terminating at the respective fold lines separating the top side panels from the outer side panels. Modified cigarette receiving slots 122 and 124 are less expensive to manufacture than cigarette receiving slots 98 and 104, but are also perhaps less aesthetically desirable than cigarette receiving slots 98 and 104.

MODIFIED BOTTOM PANEL

Figure 9:
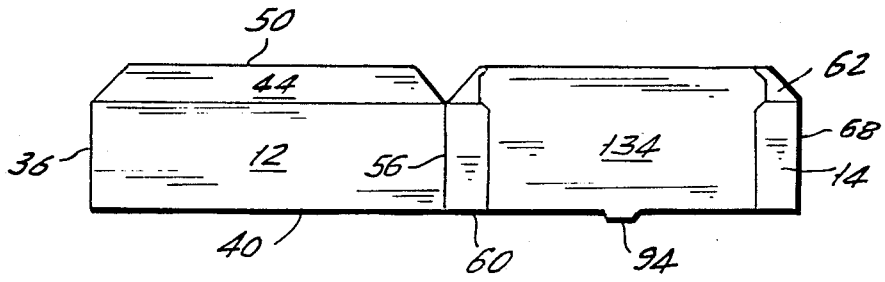
FIG. 9 is a front view of the blank of FIG. 8 after the blank has been folded for packaging.
Figure 10:
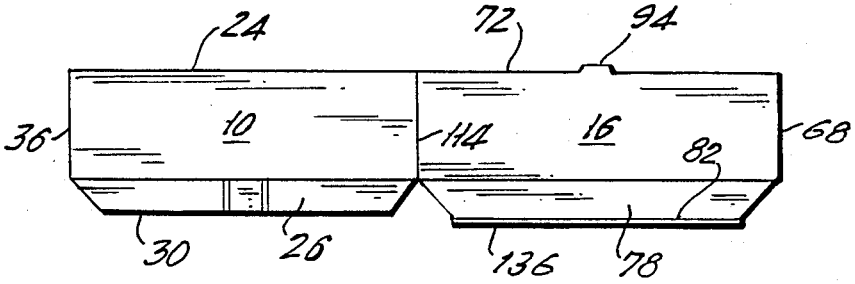
FIG. 10 is a back view of the blank of FIG. 8 after the blank has been folded for packaging.

In another alternative embodiment, also illustrated in FIG. 8, the bottom panel is separated into a bottom panel segment 132 and a bottom panel segment 134 by a score 136. Score 136 is formed by pressing on the front of the modified bottom panel 88'. Modified bottom panel 88' does not snap as neatly into the respective tab receiving slots 100, 102 and 106 as does bottom panel 88. However, modified bottom panel 88' enables more compact packaging by folding along score 136 until the front of the bottom panel segment 134 is adjacent to the front of the outer side panel 14 as illustrated in FIGS. 9 and 10.

The compactly folded blank 8' can be packaged together with a double pack of cigarettes 138 as illustrated in FIG. 11.

FOLDABLE SNUFFER

Referring to FIGS. 12 and 13, a foldable snuffer 140 may be provided in an inside corner of ashtray 121 so that a smoker can readily extinguish a cigarette (not shown) therein. Foldable snuffer 140 is formed of still foil-coated paper of heavier weight than the material of the ashtray 121. Sides 144 and 146 of the snuffer 140 are glued to the inner side panels 28 and 81, respectively. Two other sides 148 and 150 of the foldable snuffer 140 form a small rectangular compartment 152 into which a cigarette can be extinguished. Sides 144, 146, 148 and 150 are separated by fold lines so that snuffer 140 is foldable with ashtray 121 for packaging.

RIGID SNUFFER

Referring to FIGS. 14 and 15, a rigid snuffer 152 formed of aluminum or a heat resistant plastic may be located within a circular hole 154 of top side panel 44. The ashtray of FIGS. 14 and 15 does not fold up as neatly for packaging when it includes such a rigid snuffer 152. However, the rigid snuffer 152 forms a very effective means for extinguishing a cigarette.

RECTANGULAR ASHTRAY PACKAGE

A foldable ashtray in accordance with the invention may be elongated to form a rectangle. As illustrated in FIG. 16, inner side panels 28, 48, 65 and 81 may be dimensioned so as to neatly receive a pack of cigarettes 156 therein with the top of the pack of cigarettes 158 flush with the top of the ashtray. The preassembled ashtray with the pack of cigarettes 156 therein may be packaged as a unit for sale to consumers.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A blank for forming an ashtray with a bottom, said blank comprising:

a first side panel for forming a first side of said ashtray;

a first bottom flap for forming a first portion of said bottom of said ashtray, said first bottom flap being connected to said first side panel by a first fold line;

a second side panel for forming a second side of said ashtray, said second side panel being connected to said first side panel by a second fold line;

a second bottom flap for forming a second portion of said bottom of said ashtray, said second bottom flap being connected to said second side panel by a third fold line;

a third side panel for forming a third side of said ashtray, said third side panel being connected to said second side panel by a fourth fold line;

a third bottom flap for forming a third portion of said bottom of said ashtray, said third bottom flap being connected to said third side panel by a fifth fold line;

a fourth side panel for forming a fourth side of said ashtray, said fourth side panel being connected to said third side panel by a sixth fold line and adapted to be affixed to said first side panel to form said ashtray;

a fourth bottom flap for forming a fourth portion of said bottom of said ashtray, said fourth bottom flap being connected to said fourth side panel by a seventh fold line; and a bottom panel and enabling means for enabling said bottom panel to be positioned over said bottom flaps to complete said bottom of said ashtray, said bottom panel being connected to said enabling means, said enabling means being connected to one of said side panels by an eighth fold line;

wherein at least one of said side panels other than said one to which said bottom panel is connected includes a first tab receiving slot, said bottom panel including a first tab which is receivable in said first tab receiving slot to secure said bottom panel in position over said bottom flaps to complete said bottom of said ashtray.

2. The blank of claim 1, wherein said enabling means is connected to said third side panel, said first side panel includes said first tab receiving slot, said second side panel includes a second tab receiving slot, said fourth side panel includes a third tab receiving slot, and said bottom panel includes second and third tabs which are adapted to be received in said second and third tab receiving slots, respectively, to secure said bottom panel in position over said bottom flaps to complete said bottom of said ashtray.

3. The blank of claim 1, further comprising a cigarette receiving slot for holding a cigarette at the top of said ashtray.

4. The blank of claim 3, wherein said cigarette receiving slot includes a hinged piece.

5. The blank of claim 1, wherein said bottom panel includes a fold line thereacross for compactly folding said blank for packaging.

6. The blank of claim 5, further comprising a foldable snuffer.

7. The blank of claim 1, in combination with packaged cigarettes, and wherein said blank is compactly folded and can be readily unfolded and assembled by a consumer to form said ashtray.

8. The combination of claim 7, wherein said packaged cigarettes comprise two packs of cigarettes.

9. The combination of claim 7, wherein said packaged cigarettes comprise a carton of cigarette packs.

10. A blank for forming an ashtray with a bottom, said blank comprising:

a first side panel for forming a first side of said ashtray;

a first bottom flap for forming a first portion of said bottom of said ashtray, said first bottom flap being connected to said first side panel by a first fold line;

a second side panel for forming a second side of said ashtray, said second side panel being connected to said first side panel by a second fold line;

a second bottom flap for forming a second portion of said bottom of said ashtray, said second bottom flap being connected to said second side panel by a third fold line;

a third side panel for forming a third side of said ashtray, said third side panel being connected to said second side panel by a fourth fold line; p1 a third bottom flap for forming a third portion of said bottom of said ashtray, said third bottom flap being connected to said third side panel by a fifth fold line;

a fourth side panel for forming a fourth side of said ashtray, said fourth side panel being connected to said third side panel by a sixth fold line and adapted to be affixed to said first side panel to form said ashtray;

a fourth bottom flap for forming a fourth portion of said bottom of said ashtray, said fourth bottom flap being connected to said fourth side panel by a seventh fold line; and a bottom panel connected to one of said side panels by an eighth fold line;

wherein at least one of said side panels other than said one to which said bottom panel is connected includes a first tab receiving slot, said bottom panel including a first tab which is receivable in said first tab receiving slot to secure said bottom panel in position over said bottom flaps to complete said bottom of said ashtray;

wherein:

(a) said first side panel is adapted to form a double-walled structure and includes:

(1) a first outer side panel connected to said first bottom flap by said first fold line;

(2) a first top side panel connected to said first outer side panel by a fold line; and (3) a first inner side panel connected to said first top side panel by a fold line;

(b) said second side panel is adapted to form a double-walled structure and includes:

(1) a second outer side panel connected to said second bottom flap by said third fold line;

(2) a second top side panel connected to said second outer side panel by a fold line; and (3) a second inner side panel connected to said second top side panel by a fold line;

(c) said third side panel is adapted to form a double-walled structure and includes; p2 (1) a third outer side panel connected to said third bottom flap by said fifth fold line;

(2) a third top side panel connected to said third outer side panel by a fold line; and (3) a third inner side panel connected to said third top side panel by a fold line, said third inner side panel being connected to said bottom panel by said eighth fold line; and (d) said fourth side panel is adapted to form a double-walled structure and includes:

(1) a fourth outer side panel connected to said fourth bottom flap by said seventh fold line;

(2) a fourth top side panel connected to said fourth outer side panel by a fold line; and (3) a fourth inner side panel connected to said fourth top side panel by a fold line.

11. The blank of claim 10, wherein:

said blank further comprises an elongated tab connected to said first side panel by a perforation; and said first tab receiving slot is cut out of said elongated tab and said first inner side panel.

12. An ashtray comprising:

first, second, third and fourth side panels, said side panels being connected to each other by fold lines, at least one of said side panels including a tab receiving slot;

first, second, third and fourth bottom flaps connected to said first, second, third and fourth side panels, respectively, a portion of said first bottom flap being affixed to said second bottom flap, a portion of said second bottom flap being located above said third bottom flap; and a bottom panel and enabling means for enabling said bottom panel to be positioned over said bottom flaps, said bottom panel being connected to said enabling means, said enabling means being connected to only one of said side panels by a fold line, said bottom panel including a tab which is received within said tab receiving slot to secure said bottom panel in position over said first, second, third and fourth bottom flaps.

13. The ashtray of claim 12, in combination with a pack of cigarettes, said pack of cigarettes being disposed within said ashtray.

14. A disposable ashtray, comprising:

double walls, said double walls being formed of folded paper-like material, said double walls having a flat top surface, said flat top surface having a hole therein; and a relatively rigid, fireproof snuffer located within said hole.

* * * * *